United States Patent [19]

Sperber

[11] Patent Number: 4,530,468

[45] Date of Patent: Jul. 23, 1985

[54] REDUCED FIBER INSULATION NOZZLE

[76] Inventor: Henry Sperber, 8 Red Fox La., Englewood, Colo. 80111

[21] Appl. No.: 621,846

[22] Filed: Jun. 18, 1984

Related U.S. Application Data

[62] Division of Ser. No. 265,258, May 19, 1981, Pat. No. 4,487,365.

[51] Int. Cl.[3] ..... B05B 7/04; B05B 7/14; B05D 1/02

[52] U.S. Cl. ..... 239/419.3; 239/424.5; 239/427.5; 239/428; 239/432; 239/433

[58] Field of Search ..... 51/427, 439; 239/419, 239/419.3, 423, 424, 424.5, 427, 427.3, 427.5, 428, 429, 432, 433, 325, 336; 222/630

[56] References Cited

U.S. PATENT DOCUMENTS

| | | | |
|---|---|---|---|
| 821,415 | 5/1906 | Hess | 239/433 |
| 2,965,312 | 12/1960 | Hale | 239/433 |
| 3,073,534 | 1/1963 | Hampshire | 239/424 X |
| 3,226,036 | 12/1965 | Grahn | 239/428 X |
| 3,858,806 | 1/1975 | Miller et al. | 239/8 |

FOREIGN PATENT DOCUMENTS

| | | | |
|---|---|---|---|
| 570015 | 2/1959 | Canada | 239/424 |
| 633677 | 2/1962 | Italy | 239/336 |

*Primary Examiner*—Andres Kashnikow

*Attorney, Agent, or Firm*—Sheridan, Ross & McIntosh

[57] ABSTRACT

A fiber insulation application nozzle having a small opening for introducing insulation into cavities through a small opening is provided. The diameter of the body portion of the nozzle corresponds with the diameter of the conventional deliver hose from an insulation blowing machine. The nozzle includes a reducing section tapering to an exit portion having a diameter one-third of the main body. A gas injector tube is introduced along the inside surface of the exit portion of the nozzle and is directed along the surface. Fiber insulation in the nozzle is compressed prior to entering the exit portion. The gas injected into the exit portion aids in moving the particles through the nozzle. The compressed fibers are surrounded by high pressure gas and are caused to expand into a fluffed condition upon leaving the nozzle. An impinging stream of liquid adhesive is provided within the exit portion of the nozzle so as to thoroughly wet and coat the insulation fibers within the nozzle as they exit the nozzle. As the fibers expand and fill the cavity in the fluffed condition the adhesive sets forming a rigid mass of insulation. Wedge shaped ramps can be provided within the nozzle so as to produce a turbulent flow within the nozzle. Adhesive spray nozzles can be mounted on the exterior side of the nozzle so that the applying surface will be wetted prior to the depositing of the wetted fibers.

13 Claims, 10 Drawing Figures

REDUCED FIBER INSULATION NOZZLE

This application is a division of U.S. application Ser. No. 265,258 filed May 19, 1981, now U.S. Pat. No. 4,487,365.

BACKGROUND OF THE INVENTION

This invention is directed to an insulation application nozzle for compressing and delivering fiber type insulation through a reduced area nozzle. It is more specifically directed to a reducing nozzle for fiber type insulation wherein dry or adhesive wetted insulation fibers can be compressed and forced through a reduced area nozzle with the fibers being expanded to a fluffed condition upon exiting the nozzle in either an open or confined area.

In the past it has been common to apply or place fiber type insulation such as cellulose, mineral or fiberglass type fiber insulations by the use of an insulating blowing machine. Loose fiber insulation is normally packed and sold by bags in which a large volume of insulation fibers are densely packed within the bag because of the economics of transportation and storage.

At the site where the insulation is to be used, the bags are opened and the fiber insulation material is dropped into a hopper of a large insulation application machine. The fibers are usually shredded and opened by the use of fingers or tines within the hopper which help to move the fibers into a rotating air lock where high volume, low pressure compressed air picks up the fiberous materials and conveys these materials by the use of the air through a length of flexible hose of fairly large diameter to a point where the fibers exit the open end of the hose to be poured or blown into the location where the insulation is desired. This type of application has proven to be quite satisfactory where the dry fibers can be blown into an open area where there is no restriction placed on the end of the hose or any point along its length.

At times it is necessary or desirable to apply this fiber type insulation in enclosed areas such as the interior sidewalls or ceilings of buildings or homes. In order to accomplish this type of application it is necessary to provide a number of holes in the interior or exterior walls of the structure in order to introduce the fiber material into the interior cavity. Naturally it is desirable to make these holes as small as possible to minimize the cost in closing and repairing these holes so that their location cannot be seen at a later time. This is especially true where it is intended to apply the fiber insulation through a brick wall where it is desirable to limit the outside diameter of the insulation nozzle to a size which is no larger than the height of a standard brick.

Where the conventional flexible fiber application hose is normally 2½" to 3" in diameter it is necessary to reduce the size of this application hose to approximately 1" where the brick construction is encountered. It has been found in previous attempts to reduce the size of the application nozzle to a workable configuration that the connection of a bare reducing nozzle to the end of the conventional flexible hose causes the fiberous insulation material to clog and pack inside the nozzle whereby it is frequently necessary to stop the operation and clean the nozzle before further application can be performed. This frequent plugging and cleaning operation greatly affects the ability of the contractor to minimize the time and cost required in performing an insulation job of this nature.

Because of this clogging and plugging condition it has been found almost impossible to internally introduce a liquid adhesive material within the nozzle because of the major problem of the wetted material setting up within the nozzle making it almost impossible to remove the fibers from the nozzle once this condition has occurred. On occasions there have been attempts to introduce the adhesive at the exterior end of the reduced opening of the nozzle so that the mixing will take place after the fibers have left the nozzle. This in itself has proven to be undesirable since it is still necessary to introduce the nozzle into the structure making it impossible to observe the mixing once the fiber has left the nozzle and entered the interior cavity.

PRIOR ART

The applicant is aware of his duty to disclose any and all patents of which he is aware and which would have direct or similar implications to the pesent invention. However, the inventor is unaware of any other patents on reducing nozzles of this type which would in any way teach or disclose the herein described invention.

SUMMARY OF THE INVENTION

In the past it has been found where there has been an attempt to fill an enclosed cavity such as the space between the inner and outer wall of a building structure, where a high volume, low pressure air flow has been utilized to transport fiberous insulation material for filing the cavity, problems have occurred. It has been found that where a high air volume, low pressure carrier medium has been utilized actual bulging of the walls of the cavity have occurred.

This invention is directed to a reducing and expansion nozzle for the installation of fiberous insulation material. It is more specifically directed to a fiberous insulation material nozzle which fluffs or expands the fibers and which also can be used to wet the fibers and the application surface with an adhesive to provide a build up of insulation material.

In the past there have been attempts to provide a nozzle which reduces the size of the conventional transfer hose from the normal 2½" to 3" diameter to a 1" or 1½" diameter so that the insulation can be injected into a hollow cavity such as that present in a wall or enclosed area. It has been found that any time the nozzle is reduced in size there is a tendency for the fiberous material to collect and pack causing a back pressure in the system. Invariably, it is necessary periodically to shutdown the blowing machine and clean the nozzle in order to clear the obstruction. This not only disrupts the operation, but adds considerably to the cost involved. Another problem which has been found relates to the installation of insulating materials on an exterior or interior surface. Although it is possible to glue or staple batt type insulation to the surface, it is so much easier and faster to be able to apply the fiberous insulation material in a blowing and spray process. The problems that have evolved in the past are that the fiberous material is usually received and applied in a readily compressed condition. This not only requires the use of considerably more material but the material that is used does not provide the insulation qualities that it should.

For the reasons stated herein, it is an object of the present invention to provide an insulation application nozzle which allows the insulation to be introduced through a small opening in a cavity or enclosed area.

It is another object of the present invention to allow the insulation to be installed by a blowing process whereby the carrier air is utilized to fluff and expand the fiberous material to provide a lightweight, highly insulating layer.

A still further object of the present invention is to provide a reducing nozzle which incorporates an adhesive material applied to the insulation particles as they pass through the nozzle in order that a wetted insulation material is provided which when dry will prevent the insulation from packing with age due to its own weight.

A tertiary object of the present invention is to allow the expanded, wetted fiberous insulation material to be applied to an exterior or interior surface of an object whereby a layer of insulation material having superior heat insulating characteristics can be applied to any surface.

Another object of the present invention is to provide a reducing insulation application nozzle which is both easy to manufacture, low in cost and yet capable of operating trouble free and without the necessity for constant cleaning.

The present invention utilizes a venturi principle whereby the reduced change in size of the nozzle converts the energy from a high pressure condition to a high velocity condition. The body or main portion of the nozzle is usually of an enlarged size which is similar to or the same as the conventional flexible air hose which is utilized in the insulation blowing machines for transporting and directing the fiberous material to the desired location. The flexible hose is attached to one end of the body portion of the nozzle. The opposite end of the nozzle is formed as a reducer which provides a transition from the larger diameter to the a smaller diameter of approximately one-third the size. The reduced diameter or exit section can be of any length desired but is usually at least 4" minimum to exceed the width of a standard brick. Usually the transition section of the nozzle is of a smooth inner surface and provides a gentle change from the larger diameter body to the smaller diameter exit or outlet section.

In the basic nozzle a high pressure auxiliary air or gas tube is provided on the inside of the transition portion with the downstream outlet of the tube positioned adjacent to the inside surface of the reduced size exit portion. A threaded boss or external connection for an auxiliary source of high pressure air or gas can be provided on the outside of the nozzle either in the body or transition portion to supply air to the internal tube. The tube in its present position acts as an ejector to further produce a lower downstream pressure in the transition portion to aid in pulling the fiber insulation particles through the reducing section and force or push these particles through the outlet opening so they move easily through the nozzle without packing or clogging. Thus, the auxiliary gas stream provides two functions of pulling or aiding the fiberous material through the reducing section of the nozzle and pressurizing and pushing these same particles through the nozzle so that they clear the nozzle without problem.

As an additional benefit from the present design, the fiberous material is considerably compressed as it passes through the exit portion of the nozzle and is still at a relatively high pressure. As the fibers exit the outlet opening of the nozzle itself, the air pressure trapped within the fibers is quickly expanded to atmospheric pressure causing the fiberous material to expand into a low density or fluffed condition. This fluffing of the fibers in an insulation material greatly reduces the density and enhances the K factor for the insulation, providing a considerably increased benefit. This expanded condition of the fibers allows less material to be used to provide the same insulation factor or, as an alternative, allows the same amount of insulation to be used with an increased thermal insulation factor.

The benefits from this same nozzle can be greatly increased by providing an adhesive injection within the nozzle during the flow of the fiberous material. Thus, in addition to the auxiliary air or gas supply provided within the nozzle itself a like arrangement can be provided for introducing a suitable adhesive material, such as polyvinyl, acrylics or acetates, in the same way. Thus, an internal adhesive tube arranged similar to the gas tube can be provided within the nozzle. This adhesive injector tube can be arranged diametrically opposite the nozzle away from the gas injector so that the gas injector is providing a movement force along one side while the adhesive stream is providing a similar force on the opposite side of the reduced portion of the nozzle. The pressurized adhesive fluid stream exits the tube in a spray nozzle configuration to adequately spray the adhesive so as to substantially coat the fiberous material as it passes through the exit portion and leaves the nozzle outlet.

For the same reasons as described for the air or gas characteristics in expanding the fiberous material, the adhesive also provides some measure of expansion but also coats the fibers so that upon setting, the fibers will remain in the expanded or fluffed condition. Thus, the fibers as installed by the nozzle of the present invention will fill the cavity and prevent this insulation after the adhesive has set from packing over a period of time so as to reduce the overall insulation factor. Control valves and pressure gauges are provided on each of the fluid inlet streams to the nozzle. In this way, control can be provided in the nozzle so that sequential operation can be performed whereby the nozzle will be left in a clean, unobstructed condition.

In a further embodiment of the present invention the nozzle can be provided in a molded configuration which provides an annular channel or collar around the outside of the body portion of the nozzle which can be used as a partial manifold for various auxiliary fluids to be used in the nozzle. In one embodiment the circular collar or manifold is partitioned into two compartments with one compartment provided for the auxiliary air with the remaining portion arranged for carrying the liquid adhesive material. On the forward face of the collar are provided a plurality of spray nozzles which communicate with the adhesive portion of the internal cavity. Within the body of the nozzle extending from the body portion into the transition area are provided wedge shaped platforms which are arranged diametrically opposite each other. Through one or both of these wedge shaped platforms can be provided internally drilled bores which communicate with the adhesive portion of the manifold and the air portion. With the precise angle of these bores the auxiliary air is properly directed into the transition portion for transporting the fiberous material. The adhesive bore with a suitable spray nozzle provided at the outlet is also utilized to wet the fiberous material when desired. Flow control valves and pressure gauges can be provided on each of the fluid manifold sections of the collar. In combination with the internal adhesive spray nozzle and the external nozzles it is possible to utilize this arrangement for applying the fiberous insulation material to an exterior surface so that a built-up layer of insulation can be accomplished. In addition, it is possible to use this same nozzle or the basic wetting nozzle in the manufacture of batt type insulation which can be easily handled and installed where desired.

The wedge shaped platforms or ramps are arranged so that one section can begin first and end prior to the transition portion of the nozzle which causes the incoming air and fiberous materials to be deflected across the nozzle to the opposite wall. A similar type wedge shaped platform or ramp is provided on the opposite side, but this one extends further into the transition portion of the nozzle and causes the air and fiberous material to be deflected back towards the reduced exit portion. In this way, the fiberous material is mixed and deflected into the proper air path for addition of the auxiliary airstream and adhesive material to provide the novel features which have been found to exist in this invention.

The material which can be used in the fabrication of the insulation application reducing nozzle which is described herein can be provided as desired. In most cases, a lightweight metal which can be easily machined or cast can be utilized. These materials would include aluminum, brass or steel. In addition, it is possible to manufacture and mold the nozzle according to the present invention by using plastics or synthetic resins which also can be mixed with reinforcing fibers such as fiberglass.

It is to be understood that where ever in the course of this specification there is a reference to fiber insulation material it is intended that this shall include cellulose, mineral, fiberglass or any other similar material which can be applied as described herein.

BRIEF DESCRIPTION OF DRAWINGS

Other features of the this invention will appear in the following description and independent claims, reference being made to the accompanying drawings forming a part of this specification, wherein like reference characters designate corresponding parts or portions thereof in the different views.

DETAILED DESCRIPTION OF THE DRAWINGS

Figure 1:
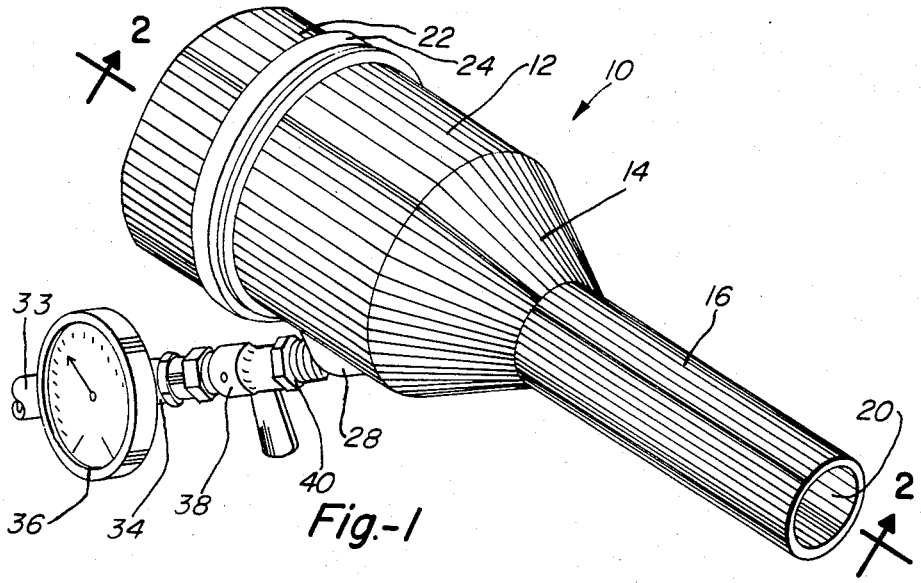
FIG. 1 is a perspective view showing the reducing nozzle according to the present invention with an auxiliary gas or air inlet provided in the lower portion of the nozzle.

Turning now more specifically to the drawings, FIG. 1 shows the fiber insulation reducing nozzle 10 according to the present invention which includes the body portion 12, transition portion 14 and exit portion 16. The nozzle has an inlet opening 18 provided at the end of the body portion 12 and an outlet opening 20 at the downstream end of the exit portion 16.

In the application of most fiberous insulation materials a large size insulation blowing machine (not shown) is provided for shredding the compacted particles into a loose mass which is then fed into a compressed airstream. The low pressure, high volume airstream which is commonly utilized is provided for transporting or carrying the loose fiberous particles. A flexible hose of approximately $2\frac{1}{2}''$ to $3''$ diameter is provided for transporting the fiberous material along with the carrier air from the blowing machine to the desired location. In the present invention, the reducing nozzle is attached to the end of the flexible hose for the purpose of reducing the overall diameter of the exit opening so that the fiberous insulation may be forced into a closed cavity or small area.

The flexible hose 22 is attached to the inlet end of the body portion 12 by means of a large hose clamp 24. A number of circumferential ridges 26 can be provided on the outside surface of the body portion near the inlet opening to provide an airtight seal to positively connect and secure the hose 22 to the nozzle 10. The outside diameter of the body portion 12 of the nozzle 10 is sized to fit the inside diameter of the hose 22 and is usually $2\frac{1}{2}''$ to $3''$. The exit portion 16 of the nozzle 10 is usually of an outside diameter of $1''$ or slightly larger. This portion is usually sized to adequately fit the small openings which are required to be made in the side of a structure such as a home where a hole is drilled through the siding or a brick is removed. Naturally, it is best to keep this opening as small as possible to minimize the cost of replacing or repairing the opening and, thus is it desirable to limit the diameter of the exit portion to no greater than $1\frac{1}{2}''$. Although it is has been found that a shorter length can be utilized, it is preferable to provide a length of at least $4''$ for the exit portion 16. This allows the nozzle to be inserted through the removed brick or opening to a sufficient depth to allow the fiber to enter the internal cavity of the structure.

The reducing or transition portion of the nozzle has a smooth curved interior surface which gently reduces the larger diameter of the body portion to the small diameter of the exit portion. The change of diameter is usually in the range of 3:1 to 2:1 with the transition extending over a sufficient length of several inches to provide a smooth continuous flow section.

A reinforced boss 28 provided on the side of the body portion 12 can be arranged to receive a threaded bore 30. An internal tube or conduit 32 can be secured as by brazing or welding to the inside opening of the threaded bore and arranged to lie along the side surface of the transition portion with the outlet opening of the tube positioned in a tangential arrangement along the inside surface of the exit portion. The tube 32 can have a $\frac{1}{4}''$ internal diameter or smaller as desired. The outlet end of the tube 32 is positioned slightly downstream of the end of the transition portion 14 so that fluid exiting from the tube will be directed along the side so as to cause a channeling or tunnel feeding effect on the fibers passing through the exit portion.

It is desirable for the proper function of this invention that the tube closely adhere to the inside surface of the nozzle to obtain the desired results.

Figure 2:
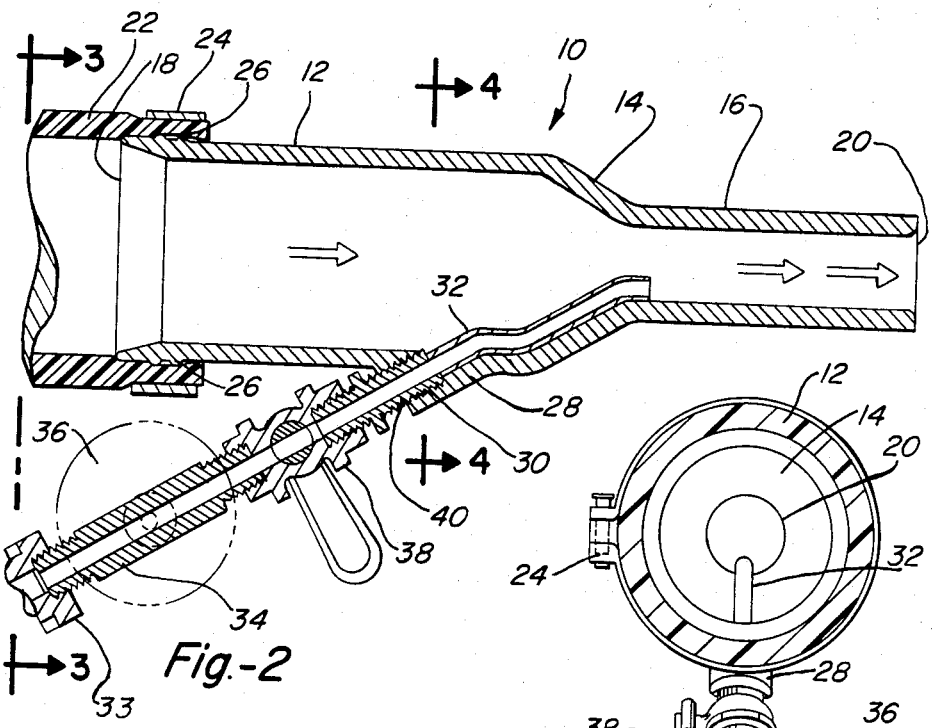
FIG. 2 is a cross-sectional view taken along the lines 2—2 of FIG. 1 and shows the position of the auxiliary air tube provided on the inside surface of the nozzle.
Figure 3:
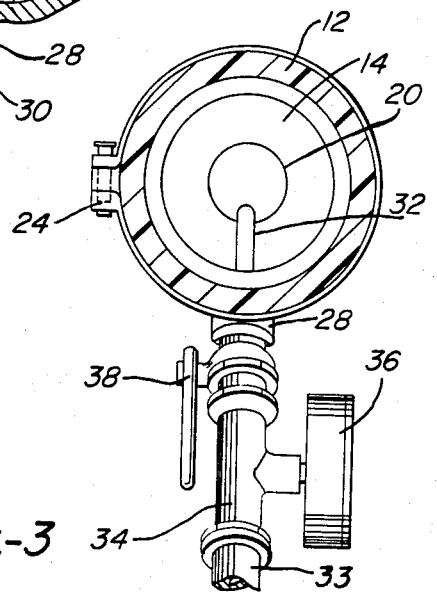
FIG. 3 is a cross-sectional view taken through the lines 3—3 of FIG. 2.
Figure 4:
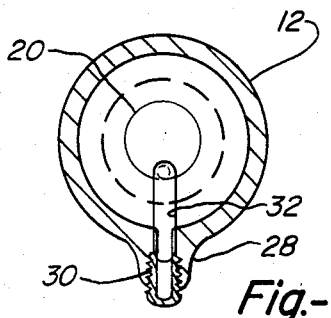
FIG. 4 is a cross-sectional view taken along the lines 4—4 of FIG. 2 and shows the position of the air tube within the nozzle.

As illustrated in FIG. 2, an auxiliary, high pressure source of gas such as air can be connected to the threaded boss 30 by a hose 33, tee fitting 34 having a pressure gauge 36 mounted therein, a manual valve 38 which in turn is connected to a threaded coupling 40 inserted into the threaded boss 30. The valve 38 is merely provided to control the flow of air through the exit portion when the fiberous material is being applied.

It is to be understood that any type of fitting, coupling and valve arrangement desired can be utilized with this nozzle and any type of hose or high pressure source can be utilized. It is also important to remember that any suitable gas can be introduced through the internal ejector nozzle arrangement which is described herein.

In operation, the blowing machine is started and the desired fiberous insulation materials such as fiberglass, Rockwool, cellulose insulation or any other type of fiberous or particle insulation is introduced to the machine. In the conventional insulation blowing machine it is common to utilize a volume of air for transporting the fiberous material of as much as 230 cubic feet per minute at a pressure of 4–6 psi. With the reducing nozzle which is provided by the present invention it is possible to reduce the carrier air flow down to approximately 25 cubic feet per minute with a slightly higher pressure of 15 to 20 psi. Only minor adjustments are required to be made on the conventional blowing machines to make this change.

It has been found in the past that with the high volume, low pressure type of fiberous material application, if this airstream and material is introduced into a closed cavity within a structural wall, sufficient volume and air pressure is present to actually bulge the wall of the structure. It has been found, however, that with a low volume, high pressure air application as provided with the present invention no bulging of the wall is evident eliminating a major problem which occurs when applying insulation to a closed volume. This higher pressure expanding from the outlet opening of the exit portion of the nozzle provides a very important function in allowing the compressed fibers leaving the exit portion to expand to atmospheric pressure causing the fibers to be greatly expanded or fluffed into a very light consistency. This feature greatly enhances the insulation characteristics of the material.

Figure 5:
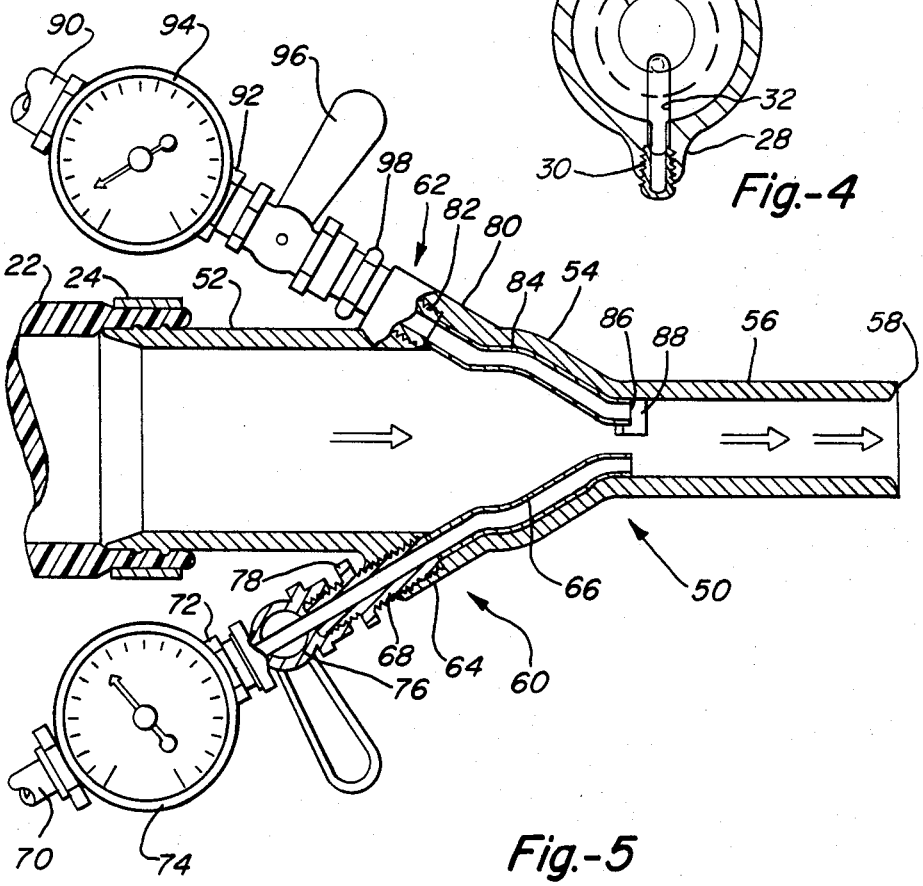
FIG. 5 is a side cross-sectional view showing two fluid inlet tubes which carry the auxiliary air and adhesive and their position along the inside surface of the reducing nozzle.

In FIG. 5 is shown another embodiment of the insulation application reducing nozzle in which the nozzle 50 includes a body portion 52, transition portion 54 and exit portion 56 which ends in an outlet opening 58. The flex hose 22 from the blower insulation application machine is secured to the end of the body portion 52 by the clamp 24. The main nozzle proportions and dimensions are similar to those which were described for the first embodiment except that in this arrangement two injector devices 60 and 62 are included. The ejector device 60 which is provided for the gas or airstream includes a reinforced boss 64 provided on the side of the body portion 52 in the same manner as previously described. The gas tube 66 is jointed such as by welding or bracing to the outlet end of the boss in communication with a threaded bore 68. The tube 66 is shaped to closely follow the contour of the internal surface of the transition portion and with a short section extending downstream in the exit portion of the nozzle. The outlet opening from the gas tube is arranged so that the gas flow is tangential along the inside surface of the exit portion to provide the same ejector principle which was provided for the previously described nozzle. With the present embodiment the nozzle 50 also includes a second ejector device 62 which provides an adhesive wetting agent for the fiberous insulation material as it passes through the nozzle. A second reinforced boss 80 is provided on the opposite side of the body portion 52 in a substantially diametrically opposite position from the boss 64. In the same fashion, a threaded bore 82 is provided in the boss with an adhesive ejector tube 84 secured to the outlet opening of the threaded bore 82, the tube 84 is shaped similar to the tube 66 so that it follows the inside contour of the body portion 52 and transition portion 54 with a short section lying along the inside surface of the exit portion 56. The outlet 86 of the tube 84 can have a spray nozzle 88 attached to the end of the tube 84 so that the liquid adhesive is sprayed in a pattern which will cross the full area of the exit portion 56. The adhesive ejector device 62 is connected to a generally high pressure source of liquid adhesive through a flexible hose 90, tee fitting 92 which has a pressure gauge 94 mounted therein, manual shutoff valve 96 and threaded coupling 98 which is threaded into the bore 82.

The embodiment which is provided by reducing nozzle 50 includes the novel ejector principle as previously described with the addition of the introduction of the adhesive stream. The spraying of the adhesive into the airstream of the nozzle also aids the ejector principle which further helps in pulling the fiberous insulation material through the body transition portion of the nozzle and the forcing or pushing of the compressed fibers through the exit portion. In this way, dry fibers are moved through the body portion where they are compacted through the transition area before they are wetted by the adhesive spray. In the compacted and pressurized condition provided in the exit portion the fibers are thoroughly wetted on their outer surface by the adhesive material before they exit the outlet opening 58. They are greatly expanded and fluffed by the expansion of the internal pressure to atmospheric pressure.

In this way, the fiberous insulation material which is produced by this nozzle shows a light, expanded, consistency which is thoroughly wetted prior to being introduced into the closed cavity or desired area. Through this process the adhesive wetted material in its expanded condition is allowed to dry and set in the cavity preventing it from packing or shrinking in the cavity thus, providing a continuous permanent insulation within the space.

In operation it is merely a matter of starting the air source through the blowing machine and introducing the fiberous material into this airstream to be carried through the flexible hose 22 to the nozzle 50. Prior to the fiberous material actually reaching the nozzle 50 the auxiliary ejector air or gas stream is introduced to the nozzle 50 through the reinforced boss 60 by opening the manual shutoff valve 76. The gas stream is caused to enter the exit portion of the nozzle in a tangential arrangement so that the fiberous material when they reach the transition portion 54 of the nozzle 50 they will move continuously and freely into the exit portion where they will be ejected through the reduced diameter outlet 58. Once the fiberous stream has been started the adhesive shutoff valve 56 is opened to introduce the high pressure adhesive liquid to the spray nozzle 88 where it is sprayed across the cross-section of the exit portion 56 so that each fiber of the insulation material is thoroughly wetted prior to leaving the outlet opening 58. It is to be understood that the reinforcing boss 80 and adhesive tube 84 can be positioned in any circumferential position around the body portion 52 of the nozzle, but is has been found that being positioned diametrically opposite to the air tube 66 has produced satisfactory and novel results.

Figure 6:
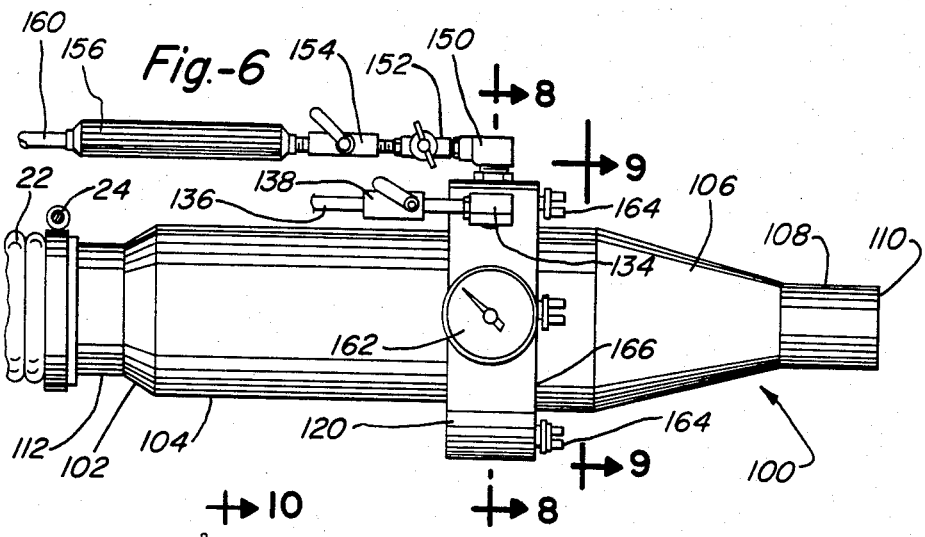
FIG. 6 shows a side elevation view of another embodiment of the present invention wherein a manifold collar and external adhesive spray nozzles are provided on the exterior body portion.
Figure 7:
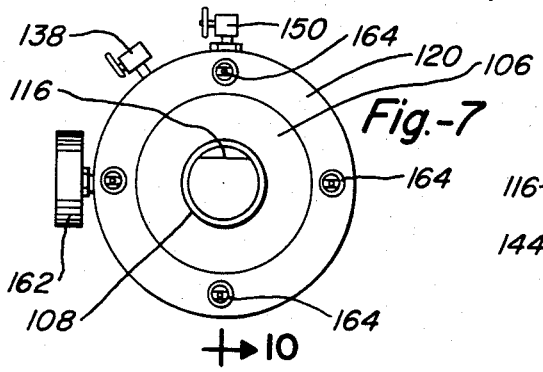
FIG. 7 shows an end view of the nozzle according to this embodiment.
Figure 8:
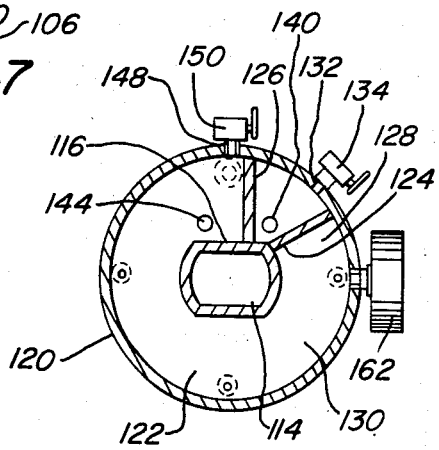
FIG. 8 is a cross-sectional view taken along the lines 8—8 of FIG. 6 and shows the internal portion of the manifold collar section of the nozzle.
Figure 9:
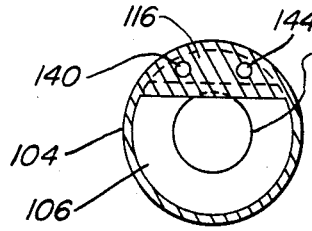
FIG. 9 is a cross-sectional view taken along the lines 9—9 of FIG. 6 and shows the body portion prior to the transition portion.

In a similar fashion another embodiment of the fiberous insulation material reducing nozzle according to the present invention is shown in FIG. 6. In this embodiment the nozzle 100 includes an inlet expansion section 102, body portion 104, transition portion 106 and exit portion 108 ending in an outlet opening 110. An inlet connection section 112 which is part of the expansion portion 102 is connected to the flexible hose 22 of the insulation application blowing machine by means of the hose clamp 24. The outside diameter of the inlet section 112 is the same as the inside diameter of the flexible hose 22 providing an airtight and secure attachment. Downstream of the inlet portion 112 the body portion 104 increases to a larger diameter of approximately 1" to 1½" greater diameter. The first section of this body portion forms a cavity 111 in which the fiberous material and carrier air expand to a greater volume with the fiberous particles and carrier air slowing in velocity. At a point which is about one-third of the overall length of the body portion 104, two opposed internal ramp surfaces 114 and 116 are formed. These ramp surfaces 114 and 116 diverge inwardly toward each other with the ramp or platform surface 114, being the shorter of the two, ending in a flat face 118.

The other ramp surface 116 provides a continuous elongated surface which extends well into the transition portion of the nozzle and ends in a similar flat face 119 which is angled slightly to the longitudinal axis of the nozzle.

If it is desirable, the ramp 114 can start upstream of the ramp 116 so that the carrier air and the fiberous insulation particles carried by the air are first diverted away from the ramp 114 toward the opposite surface. In turn once the air approaches the second ramp surface 116 it is deflected back through the transition portion causing a turbulence within the nozzle which allows the particles to be better mixed, compressed and forced through the exit portion 108.

Figure 10:
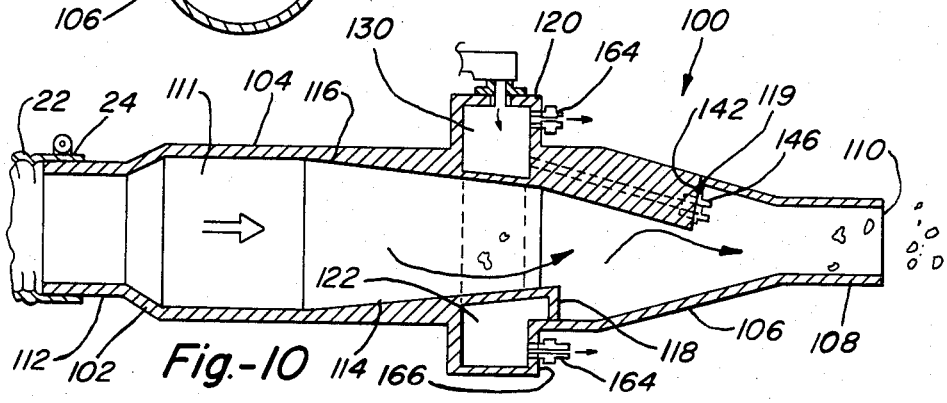
FIG. 10 is a cross-sectional view of the nozzle showing the internal ramps used to deflect the carrier air flow and fiber through the nozzle.

A hollow collar 120 is provided circumferentially around the outside surface of the body portion 104. The interior cavity 122 within the collar is closed and extends completely around the perimeter of the body portion. This internal cavity 122 extends into the ramp areas 114 and 116 as can be seen in FIG. 10. This cavity acts as a manifold and can be partitioned to accommodate more than one fluid. In the present embodiment, two partitions 124 and 126 are provided within the collar 120 to divide the internal cavity 122 into two separate compartments such as the small cavity 128 and the larger cavity 130 which extends approximately 320° around the circumference of the body portion 104.

The cavity 128 is connected to a source of high pressure gas or air as previously described. A threaded bore 132 is drilled through the surface of the collar 120 so as to communicate with the internal cavity 128. A fitting 134 is positioned in the threaded bore 132 to which a flexible hose 136 and manual shutoff valve 138 are connected. The hose 136 is in turn connected to a source of pressurized gas or air suitable for the intended purpose.

An elongated passageway 140 is provided through the ramp section 116 from the face 119 and positioned precisely to enter and communicate with the cavity 128. The outlet 142 of passageway of 140 can be provided with a suitable nozzle as desired to provide a precise flow stream into the transition area within the nozzle as well as the exit portion 108. The direction of the gas flow from the passageway 140 is critical to the proper operation of the nozzle in that it is directed to cross the longitudinal axis of the nozzle at a point downstream of the transition portion and well within the exit portion of the nozzle.

Where it is desired to utilize an adhesive liquid for wetting the fiberous insulation particles internally of the nozzle prior to their expansion and delivery, a second passageway 144 extending from the face 119 and properly directed to communicate with the cavity 130 can also be provided. A suitable spray nozzle 146 can be provided in the outlet opening of the passageway 144 to provide the desired spray pattern for delivering the adhesive liquid to the fiberous insulation particles. By the use of a satisfactory spray pattern all of the particles can be completely wetted. This operation is further enhanced by the turbulent main air flow caused by the ramps 114 and 116. This air flow is illustrated by the air flow represented by the arrows C which are shown in FIG. 10.

The pressurized adhesive liquid is introduced into the cavity 130 through the threaded bore 148 which is provided on the top surface of the collar 120 and arranged to communicate directly with the cavity 130. A fitting 150 is positioned within the threaded bore 148 which in turn is connected to a flow throttling valve 152, manual shutoff valve 154, filter 156 and flexible hose 160. The hose is connected in some suitable source of pressurized adhesive liquid (not shown). A pressure gauge 162 can be threadedly mounted in the surface of the hollow collar 120 so as to communicate with the cavity 130. This pressure gauge will continuously show the actual pressure of the adhesive liquid which is present within the manifold. In this way, the internal pressure within the manifold can be controlled by the throttling valve 152 to provide the desired flow rate to satisfactory operate the spray nozzles.

In the reducing nozzle 100, which is illustrated in this embodiment, the hollow manifold collar 120 provides an additional feature. A number of liquid spray nozzles 164 are threadedly mounted on the face 166 of the collar 120 and communicate with the cavity 130. Usually the face 166 is arranged perpendicular to the longitudinal axis of the nozzle 100 and so the liquid spray patterns provided by the nozzles 164 are arranged to surround the stream of adhesive wetted fiberous insulation particles which are exiting from the outlet 110.

In operation the nozzle 100 can be utilized for applying wetted fiberous insulation particles to an external surface to provide a built-up layer of expanded insulation fibers which has a unique temperature insulating capability. Thus, once the operation of the nozzle begins the wetted fibers are directed from the exhaust portion 108 of the nozzle 100 toward the desired surface. At the same time, adhesive liquid is being sprayed by the external nozzles 164 onto the surface upon which the fibers will impinge. The expanded or fluffed fibers readily adhere to the wetted surface with the adhesive coating on the fibers themselves making the overall blanket layer of insulation extremely rigid and durable after setting. Thus, as can be seen, the reducing nozzle as described herein cannot only be used for applying dry or adhesive wetted insulation into a cavity or a structure but also it can be used to apply a layer of expanded insulation to an exterior surface of a structure.

It is to be understood that if a third liquid such as a catalyst is required to be introduced into the insulation fiber particles which are passing through the nozzle it is possible to provide additional partitions within the cavity 122 and a third passageway to allow the third liquid to be introduced into the main fiber stream as desired.

In addition to the other uses which have been described for the insulation application nozzle described herein it has been found that the internal adhesive wetting nozzle 50 can be utilized in the manufacture of batt type insulation. A number of strategically positioned and directed nozzles 50 according to the present invention can be arranged to deposit adhesive wetted fiberous insulation particles into a mold area through which a continuous sheet of backing material such as paper or foil can be passed at any desired speed. The wetted insulation fibers can be deposited on the backing material to any desired thickness. As the backing material continuously moves from the mold area it can pass through a drying oven to speed the setting of the adhesive. After passing from the drying oven the continuous strip of insulation can be rolled into an desired configuration for shipping or storage.

It is also possible to deposit the wetted fiber insulation material on a continuously traveling endless belt without the backing sheet so that only the insulation layer itself is produced without the backing support. This process has been found to be very beneficial when working with mineral or cellulose type insulation particles and allows these particles to be handled and used in ways which have up to now been impossible.

While a new and novel fiber insulation application nozzle which provides an ability to apply fiber through a reduced size opening and in an expanded particle configuration has been shown and described in detail, it is obvious that this invention is not to be considered to be limited to the exact form disclosed and changes and variations in detail and construction of the various embodiments may be made herein within the scope of the invention without departing from the spirit thereof.

What is claimed is:

1. A fiber insulation application nozzle having a reduced sized outlet opening for applying fiber insulation particles discharging from an insulation blowing machine the nozzle comprising:

(a) a body portion having an inlet opening at one end, said inlet opening being attached to a transporting hose connected to said blowing machine, said body portion having an outside diameter which is approximately the same as said application hose;

(b) an exit portion which has a diameter which is smaller than said body portion;

(c) a transition portion positioned between said body portion and exit portion and arranged to provide a smooth conversion from the diameter of said body portion to the smaller diameter of said exit portion;

(d) a means for introducing an auxiliary stream gas into said nozzle in in a direction which is adjacent to and parallel to the inside surface of said exit portion whereby the fiberous insulation material being carried through the nozzle is aided by the auxiliary gas stream allowing it to be compressed in the transition portion and forced through the exit portion in a compressed pressurized manner whereby when the particles leave the exit portion of the nozzle they greatly expand into a fluffed condition due to the expending pressure surrounding the fiber particles; and (e) said auxiliary gas stream means includes a connection means arranged on the outside of the body portion and a conduit means mounted within the nozzle, said conduit means having a portion positioned on the inside surface of said exit portion and having its outlet opening positioned adjacent to the inside surface of said exit portion so that the auxiliary gas stream flows along and parallel to the surface of the exit portion so as to force the pressurized fiber insulation particles from the outlet opening of the nozzle so that they can be expanded to a light fluffy condition to enhance their insulating characteristics.

2. A fiber insulation application nozzle as described in claim 1 wherein the exit portion of said nozzle is at least 4" in length.

3. A fiber insulation application nozzle as defined in claim 1 wherein the diameter of said exit portion is within the range of 25 to 50 percent of the inside diameter of said body portion.

4. A fiber insulation application nozzle as described in claim 1 wherein the auxiliary gas means is positioned to create a reduced pressure in the transition portion of the nozzle and an increased pressure in the exit portion so that the insulation fibers will move through the nozzle without packing or clogging.

5. A fiber insulation application nozzle as defined in claim 1 wherein a means is provided for spraying a pressurized liquid adhesive onto the fiberous insulation particles passing through the exit portion of said nozzle whereby the fibers are wetted by the adhesive so that the expanded particles leaving the nozzle will after setting form a rigid mass which will not settle or compact with time.

6. A fiber insulation nozzle having a reduced sized outlet opening for applying fiber insulation particles discharging from an insulation blowing machine the nozzle comprising:

(a) a body portion having an inlet opening at one end, said inlet opening being attached to a transporting hose connected to said blowing machine, said body portion having an outside diameter which is approximately the same as said application hose;

(b) an exit portion which has a diameter which is smaller than said body portion;

(c) a transition portion positioned between said body portion and exit portion and arranged to provide a smooth conversion from the diameter of said body portion to the smaller diameter of said exit portion;

(d) a means for introducing an auxiliary stream gas into said nozzle in in a direction which is adjacent to and parallel to the inside surface of said exit portion whereby the fiberous insulation material being carried through the nozzle is aided by the auxiliary gas stream allowing it to be compressed in the transition portion and forced through the exit portion in a compressed pressurized manner whereby when the particles leave the exit portion of the nozzle they greatly expand into a fluffed condition due to the expending pressure surrounding the fiber particles;

(e) a means is provided for spraying a pressurized liquid adhesive onto the fiberous insulation particles passing through the exit portion of said nozzle whereby the fibers are wetted by the adhesive so that the expanded particles leaving the nozzle will after setting form a rigid mass which will not settle or compact with time; and (f) said liquid adhesive means includes a connection means on the outside of said nozzle said connection means being attached to a pressurized source of liquid adhesive and a conduit means mounted on the inside surface of said nozzle, said conduit means and connected at one end to said connection means and having a spray nozzle provided at the opposite end, said conduit means and spraying nozzle being arranged within said exit portion and adjacent to the interior surface of said portion, said spray nozzle being arranged to spray the liquid adhesive across the cross-section of said exit portion so as to thoroughly wet all of the fiber insulation particles as they pass through the exit portion of said nozzle.

7. A fiber insulation application nozzle as provided in claim 6 wherein said auxiliary gas means and said adhesive means are arranged diametrically opposite each other within said nozzle.

8. A fiber insulation application nozzle as defined in claim 6 wherein the conduit means of said auxiliary gas means and liquid adhesive means are tubes which are shaped to follow the inside contour of the transition portion of said nozzle with the outlet end of said tubes positioned slightly downstream of the intersection between said transition portion and exit portion whereby the fluids discharging from the outlets of said tubes pass into and help move the flow of fiberous insulation particles through said exit portion.

9. A fiber insulation application nozzle for applying a layer of fiberous insulation material to an external surface, the nozzle comprising:

(a) a body portion, transition portion and exit portion, said portions being joined together as an integrated unit to form an insulation application nozzle having a reduced outlet opening, the portions being hollow and the body portion having one end connected to a source of high volume, low pressure air in which fiberous insulation material is entrained;

(b) two or more tapered wedge shaped ramp surfaces formed within the nozzle and arranged to converge toward each other;

(c) a hollow circumferential collar provided around the outside surface of said body portion and in a plane which is generally perpendicular to the longitudinal axis of said nozzle;

(d) one of said ramp surfaces forms an angle which converges toward the longitudinal axis of said nozzle and ends in a flat end surface first to transverse to the axis of said nozzle;

(e) the internal cavity formed within said collar being connected to a pressurized source of fluid and a passageway being provided through said wedge shaped ramp surface so as to communicate between the end surface of said ramp and the internal cavity within said collar whereby the pressurized fluid within said cavity is introduced into the internal portion of said nozzle so as to aid the movement of the fiberous particles so that the compressed insulation fibers will expand upon exiting from the nozzle.

10. A fiber insulation application nozzle as defined in claim 9 wherein the cavity formed within said hollow collar is partitioned to form two internal compartments, a second passageway is provided through said ramp communicating with the second compartment whereby different fluids introduced within the compartments are directed simultaneously into the flow stream passing through the interior of said nozzle.

11. A fiber insulation application nozzle as defined in claim 10 wherein one compartment of the cavity of said collar is connected to a pressurized source of gas while the second compartment is connected to a pressurized source of liquid adhesive, said gas and liquid adhesive passing through said passageways and being introduced in a parallel stream into the fiberous material passing through said nozzle.

12. The fiber insulation application nozzle as defined in claim 11 wherein:

the outlet opening from said passageway containing said liquid adhesive includes a spray nozzle whereby the liquid adhesive will be sprayed in a pattern which extends across the exit portion of said nozzle whereby the fiber insulation particles will be thoroughly wetted with the adhesive prior to exiting the nozzle.

13. A fiber insulation application nozzle as defined in claim 11 wherein the compartment of the cavity of said collar in which liquid adhesive is introduced includes a plurality of spray nozzles mounted on the downstream external face of said collar and arranged so that an external spray pattern will be formed which will surround the stream of fiber insulation particles exiting from the internal portion of said nozzle whereby the wetted fiberous particles will adhere to the adhesive sprayed surface so that the particles will form a layer of insulation on said surface.

* * * * *